United States Patent [19]

Ericsson

[11] Patent Number: 4,722,155

[45] Date of Patent: Feb. 2, 1988

[54] MOBILE BUILDING CONSTRUCTION

[75] Inventor: Bengt Ericsson, Sundsvall, Sweden

[73] Assignee: Lucksta-Bergenstrom Industri AB, Sweden

[21] Appl. No.: 878,989

[22] PCT Filed: Oct. 14, 1985

[86] PCT No.: PCT/SE85/00394

§ 371 Date: Jun. 2, 1986

§ 102(e) Date: Jun. 2, 1986

[87] PCT Pub. No.: WO86/02688

PCT Pub. Date: May 9, 1986

[30] Foreign Application Priority Data

Oct. 25, 1984 [SE] Sweden ..... 8405336

[51] Int. Cl.[4] ..... E02D 35/00

[52] U.S. Cl. ..... 52/79.1; 52/127.4

[58] Field of Search ..... 52/743, 744, 79.5, 79.11, 52/127.3, 127.4, 143, 196, 197, 2, 79.1

[56] References Cited

PUBLICATIONS

Dept. of Defense, "Family Shelter Series: Outside Semimounded Plywood Box Shelter", Jan. 1962, p. 15.

D.F.P.A. Plywood, "Family Fallout Shelters", Mar. 22, 1963, p. 7.

*Primary Examiner*—Carl D. Friedman

*Attorney, Agent, or Firm*—Larson and Taylor

[57] ABSTRACT

A mobile building construction comprises a wall structure (1) intended, together with a roof, to define at least one room. The wall structure (1) comprises two spaced-apart shells (2,3) defining a gap-like space (4) which, at the top, has openings for filling heavy bulk material (13) such as macadam, gravel or the like, into said space so as to form a safety wall which is resistant especially to firing or explosive action. At the bottom, the space has one or more outlet openings (5) adapted, when desired, to allow emptying the bulk material (13) from the gap space (4) in order to release the wall structure from the load of bulk material, whereby to facilitate transportation of the building construction from one ground to another.

8 Claims, 7 Drawing Figures

MOBILE BUILDING CONSTRUCTION

TECHNICAL FIELD OF THE INVENTION

The present invention relates to a mobile building construction comprising a wall structure and a roof.

STATE OF THE ART

In military contexts, use is made of mobile building constructions in the form of containers, i.e. constructions comprising a bottom, four walls and a roof. These containers can readily be transported between different grounds, for instance by truck or helicopter, and be used for many different purposes, such as staff work, radio communication etc. Containers of this type are generally made of some kind of sandwich elements, usually in the form of a cellular plastic core disposed between two hard panels, such as plywood and/or sheet-metal. However, such sandwich elements suffer from very poor resistance both to explosive action and to firing. For this reason, the mobile housing containers hitherto used are not at all suited for use in combat areas and like areas where military operations are conducted.

BRIEF DESCRIPTION OF THE INVENTIVE CONCEPT

The present invention aims at providing a mobile building construction which can be readily moved between different grounds and yet afford reliable protection against external action, such as explosions, firing and the like. According to the invention, this is achieved more specifically in that the wall structure of the building construction comprises two spaced-apart sheels or panels which define a relatively broad gap-like space which, at the top, has one or more openings for filling heavy bulk material, such as macadam, gravel or the like, into said space so as to form a safety wall resistant especially to explosive action, and which further comprises one or more outlet openings adapted, when desired, to allow emptying said bulk material from the gap space in order to release the wall structure from the weight of the bulk material so as to facilitate transportation of the building construction from one ground to another.

FURTHER DESCRIPTION OF THE PRIOR ART

It is previously known in and per se to manufacture wall structures having double shells with a space formed therebetween which is filled with concrete. However, such wall structures provide a fully stationary construction which, because of its weight, cannot under any circumstances be moved by such means of transportation as trucks or helicopters once the concrete has been cast and set.

BRIEF DESCRIPTION OF ACCOMPANYING DRAWINGS

In the drawings,

FIG. 1 is a part sectional perspective view illustrating a building construction according to the invention, FIGS. 2 and 3 are perspective views illustrating different ways of transporting the construction, FIG. 4 is a perspective view which schematically shows how the wall structure is filled with bulk material, FIG. 5 is a perspective view showing the finished construction in place, FIG. 6 is an exploded view illustrating an alternative embodiment of the construction, and FIG. 7 is a perspective view illustrating a practical example of the use of the alternative embodiment according to FIG. 6.

DETAILED DESCRIPTION OF A PREFERRED EMBODIMENT OF THE INVENTION

Figure 1:
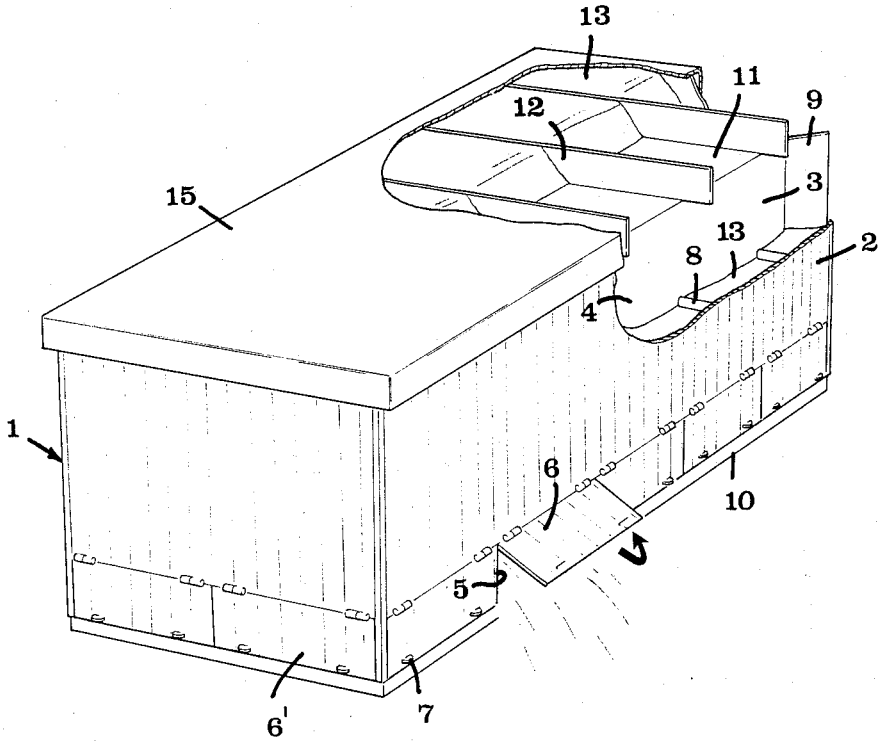

In FIG. 1, 1 generally designates a wall structure which, in the illustrated embodiment, has rectangular shape and, according to the principle of the invention, is made up of two spaced-apart shells, namely an outer shell 2 and an inner shell 3. These two shells define between them a relatively broad gap-shaped space 4. In actual practice, this space has a width of 200–400, suitably about 250 mm, and is open at the top.

In the lower portion of the outer shell 2, there are a number of outlet openings 5 which are normally closed by pivotal doors 6 which can be locked in their closed position by locking means 7 of any suitable type. Advantageously, the openings 5 are elongate and extend up to one tenth—one third, suitably one fifth of the overall height of the wall structure. In the illustrated embodiment, the opening 5 extends throughout the entire length of the wall structure and can be closed by means of a plurality of individual doors. It is also conceivable to arrange a single elongate door throughout the entire opening in the wall. It should also be noted that similar doors 6' are provided on the short sides of the wall structure and not only on the long sides thereof.

The outer shell 2 may advantageously be made of corrugated or profiled sheet metal. The inner shell 3 also advantageously consists of sheet-metal, although not necessarily profiled sheet-metal. The two shells are held together by beams or a plurality of spacer pins 8 which may be inserted through holes in at least one of the shells and connected to the respective shell, for instance by welding. At the corners of the wall structure, there may be provided reinforcing means 9 of any suitable type, for instance simple plates. At the bottom, the wall structure may have a rectangular frame 10, for instance in the form of box profiles welded together. This frame may be fully open, which means that the building construction, at least upon delivery, has no particular fixed bottom. If a bottom or floor is desired, it can be mounted afterwards.

The inner shell 3 has a panel 11 which forms a ceiling and is connected to a number of cross pieces 12, for instance sheet-metal strips placed on edge and resting on the shell 3. The panel 11 forming ceiling is located on a level below the upper edge of the outer shell 2 so as to form, together with the upper portions of the outer shell, a trough-like space intended to be filled with bulk material 13 of the same type as is filled in the gap space 4 between the shells 2 and 3.

In practice, the bulk material 13 may consist of sand and/or gravel which together with the two shells forms an excellent safety wall or barrier against different conventional weapons, such as pieces of ordnance, multiple weapons and small-arms. Other types of bulk material than sand and gravel may however also be used.

FUNCTION AND USE OF THE BUILDING CONSTRUCTION ACCORDING TO THE INVENTION

Figure 2:
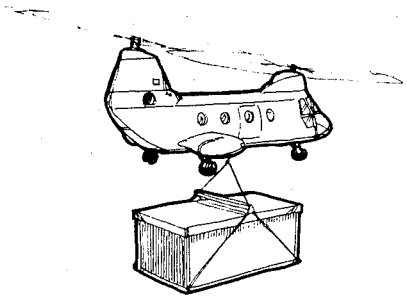
Figure 3:
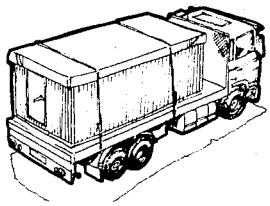
Figure 4:
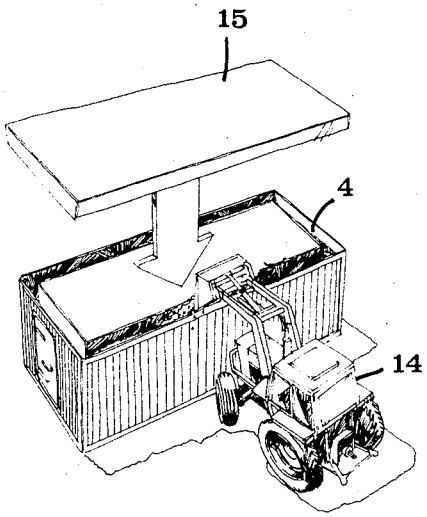
Figure 5:
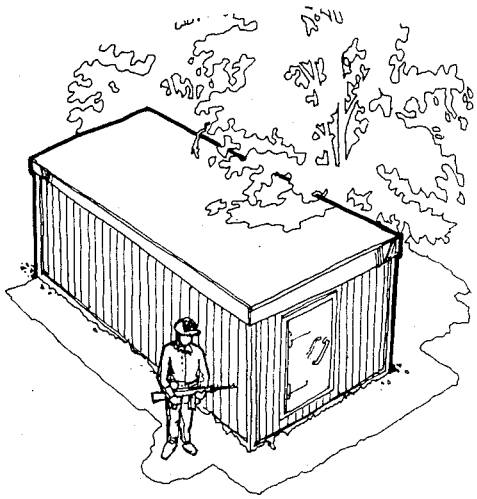

The building construction illustrated in FIG. 1 is delivered from factory without any bulk material filling any of the spaces 4 and 11, respectively. The construction can be transported to the contemplated ground, for instance by means of a helicopter or truck, as illustrated in FIGS. 2 and 3. Once on the site, the roof panel 15 is removed so as to expose the gap space 4 in the wall structure 1. This space is thereafter filled with bulk material, either manually or by means of e.g. a front end loader 14, as exemplified in FIG. 4. When the wall structure has been completely filled, the trough-like space between the ceiling panel 11 and the plane defined by the upper edge of the outer shell 2 is also filled. Finally, the roof panel 15 is mounted in place so as to form a building structure having high resistance to all kinds of military action, such as firing, remote nuclear attacks etc. It also affords protection against BC weapons, collapsing buildings, ash fall-out, fire, break-ins, and sabotage operations.

If it is desired after some time to move the building construction now described to another ground, the doors 6 are opened, whereby the bulk material at least in the wall structure can flow by gravity out of the wall structure and empty it. If the ceiling panel 11 is completely planar, the roof panel 15 can be lifted off and the bulk material on the ceiling can be removed manually by means of shovels. The building construction is thus released from the substantial weight of the bulk material, whereupon the construction can easily be moved away by conventional means of transportation, such as trucks or helicopters as previously mentioned. On the new site, the building structure is again filled with the protective bulk material in the manner described above.

Although the building construction according to the invention is primarily intended for military applications, it also has a large number of peace-time uses. Thus, the construction can readily be made safe against break-ins, fire and tapping; this makes it well suited as a store for theft-prone articles, radio station, computer office, shelter against tapping, industrial espionage etc.

Figure 6:
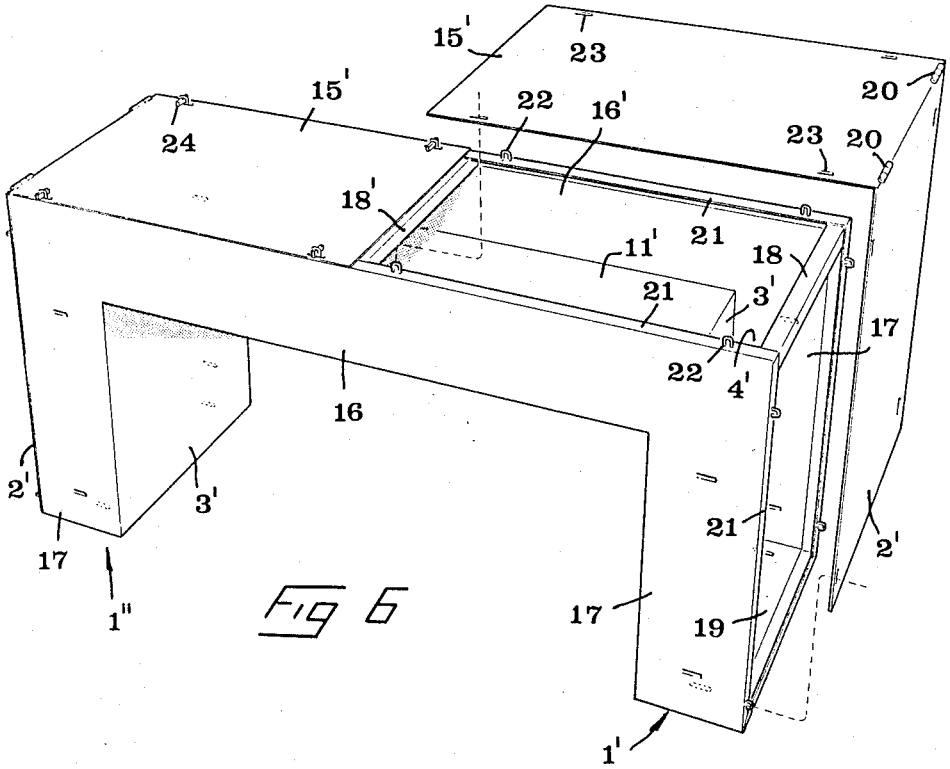

In FIG. 6, there is shown an alternative embodiment of the construction according to the invention which, in this case, is of the module type which in practical use can be built together with other, similar modules so as to form a shelter or the like. Thus, this construction has two walls 1', 1'' each of which comprises both an outer shell 2' and an inner shell 3' and which are fixedly connected to each other by a ceiling panel 11' and a pair of opposing end wall members 16, 16' in the form of vertical plates. In the same plane as the end wall members 16, 16' forming part of a roof structure, there are also provided end wall members 17, 17' which form part of a wall structure and, together with the shells 2' and 3', define gap spaces 4'. Advantageously, the end wall members are held together at their outer edges by means of reinforcing beams 18, 18'. It should also be noted that the gap spaces 4' are defined at the bottom by base members 19.

As opposed to the outer shell 2 in FIG. 1, the outer shell 2' in FIG. 6 can be dismounted and is connected to a roof-forming panel 15' by hinges 20 which allow pivotal movement of the shell and the panel relative to each other. In order to connect the shell 2' and the roof panel 15' to the frame of the module (e.g. in the form of L-beams 21), the frame is provided with a number of eyes 22 adapted to engage in elongate holes 23 in the shell and the panel, respectively, and to receive keys 24 by means of which the shell and the panel can be clamped firmly against the frame 21.

The module now described is delivered in the empty state with the shells 2' and the roof panels 15' mounted on the frame. After the module has been placed on the desired ground, optionally together with a number of other similar modules, the roof panels 15' are opened to allow filling bulk material both into the gap spaces 4' and into the trough-shaped roof space above the panel 11'. In a final stage, the roof panels 15' are keyed to the frame 21.

After terminated use of the module on a particular ground, it is emptied of the heavy bulk material in that the outer shells 2' are released from the frame and are swung outwardly about the hinges 20.

Figure 7:
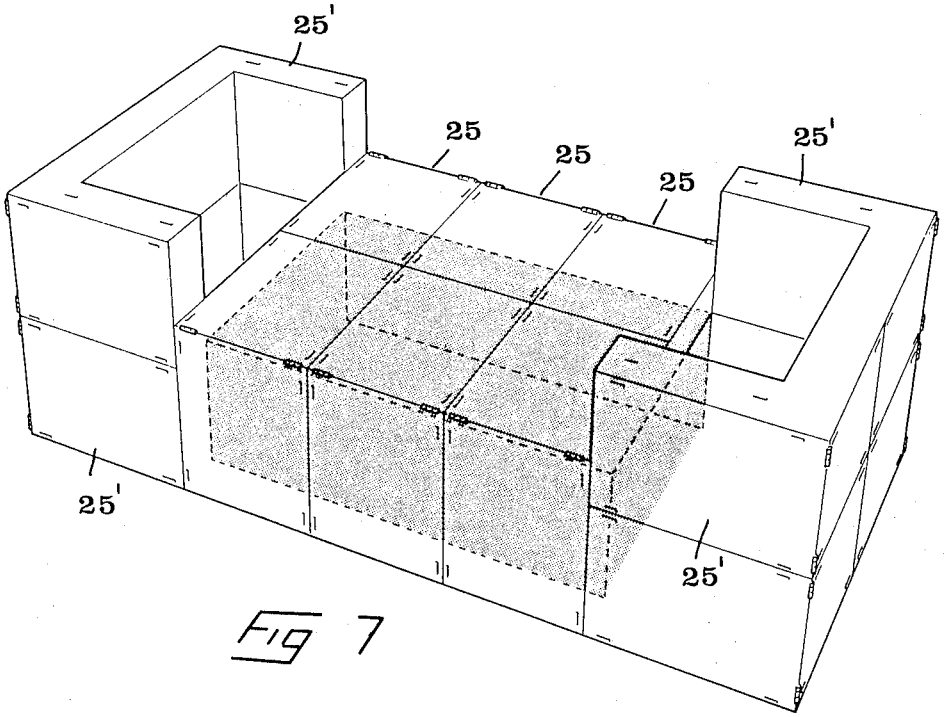

FIG. 7 illustrates a shelter composed of three central modules 25 and two pairs of modules 25' placed on edge and connected to the first-mentioned modules. In this instance, the modules 25' placed on edge can be filled with bulk material in that holes are provided or opened in the wall end members 16, 17 (not shown).

POSSIBLE MODIFICATIONS OF THE INVENTION

Naturally, the invention is not restricted only to the embodiments described above and illustrated in the drawings. Thus, it is conceivable to provide the wall structure described above with more than two shells, so as to obtain two or more gap spaces each of which may optionally be filled with different kinds of protective material. Further, the outlet openings used for evacuating the bulk material may be designed in many different ways. Thus, the illustrated doors should only be regarded as examples of possible solutions. For example, the outlet openings may be in the form of discharge tubes, optionally provided with special discharge mechanisms, for instance screws by means of which the bulk material can be discharged mechanically. It is also conceivable to entirely dispense with openings and doors in the two wall shells and instead provide openings in the base frame 10 of the wall structure, such that the bulk material can leave through these openings after the wall structure has been lifted a slight distance before it is placed on the means of transportation concerned. Furthermore, it should be pointed out that the roof structure need not necessarily be designed in the manner exemplified in the drawings. Thus, one or more concrete slabs may be placed on the wall structure and will afford substantially the same protective effect as the roof illustrated. In such a case, the ceiling 11 might be dispensed with, like the roof 15. It should also be pointed out that the entrance door to the building construction may be a conventional e.g. concrete-filled door whose weight need not be reduced in connection with transportation of the building construction, since the volume of the door constitutes but a fraction of the total volume of the wall structure and the roof.

I claim:

1. A mobile building construction fabricated of metal or the like comprising a wall structure and a roof structure, the wall structure including inner and outer spaced-apart shells or panels defining a relatively broad space therebetween having at least one opening at the top thereof for filling the space with heavy bulk material such as macadam, gravel or the like, so as to form a safety wall resistant especially to weapons fire, explosions, the effects of remote nuclear attacks and the like, said wall structure comprising at least one outlet opening for enabling selective emptying of said bulk material from said space in order to relieve the wall structure from the weight of the bulk material contained therein and to thus facilitate transportation of the building construction from one location to the other, and said inner shell including at least one panel which forms a ceiling and which is located at a level below the upper edge of the outer shell so as to form a substantially trough-like space to permit filling of the trough-like space with bulk material, said construction further comprising an outer roof panel which, together with the ceiling panel and the bulk material in the trough-like space, form a roof that is of substantially the same construction as, and is connected to, the wall structure, the at least one outlet opening being included in one of the spaced-apart walls and said construction further comprising means, comprising a moveable, pivoted door, for closing the outlet opening.

2. A construction as claimed in claim 1 wherein said door and said outlet opening are provided in the outer shell.

3. A construction as claimed in claim 1 wherein said door extends between the area of the lower edge of a said shell and an area spaced a substantial distance upwardly along the height of said shell from said lower edge.

4. A construction as claimed in claim 3 wherein said distance is one fifth of the height of said shell.

5. A construction as claimed in claim 1 further comprising means, comprising a plurality of pins, for interconnecting said spaced-apart shells and holding said shells together.

6. A construction as claimed in claim 1 wherein said door is constituted by one of said shells.

7. A construction as claimed in claim 6 wherein said door is hingedly connected to a roof panel forming part of the roof.

8. A construction as claimed in claim 7 wherein said roof panel includes means for the connection thereof to the remainder of the building construction.

* * * * *